United States Patent [19]

Wierzchowski et al.

[11] 4,188,528

[45] Feb. 12, 1980

[54] ELECTRONIC CONTROL DEVICE FOR ELECTRIC RANGES

[75] Inventors: Dieter Wierzchowski; Klaus Fischer, both of Nüremberg; Günther Formanek, Grosshabersdorf; Leonhard Scheumann, Nüremberg, all of Fed. Rep. of Germany

[73] Assignee: Licentia Patent-Verwaltungs-G.m.b.H., Frankfurt am Main, Fed. Rep. of Germany

[21] Appl. No.: 764,960

[22] Filed: Feb. 2, 1977

[30] Foreign Application Priority Data

Feb. 12, 1976 [DE] Fed. Rep. of Germany ..... 2605533

[51] Int. Cl.[2] ..... H05B 1/02

[52] U.S. Cl. ..... 219/490; 236/46 F; 219/10.55 B; 219/492; 219/507

[58] Field of Search ..... 219/482, 489, 490, 492, 219/507, 508, 491, 10.55 B; 236/78 D, 46 F, 1 E; 323/17, DIG. 1

[56] References Cited

U.S. PATENT DOCUMENTS

| | | | |
|---|---|---|---|
| 2,648,756 | 8/1953 | Vogelsberg | 219/491 X |
| 3,541,429 | 11/1970 | Martin | 219/492 |
| 3,666,921 | 5/1972 | Shevlin | 219/492 |
| 3,819,904 | 6/1974 | Novak | 219/492 |
| 3,827,345 | 8/1974 | Willson | 219/489 |
| 3,862,390 | 1/1975 | Noda | 219/10.55 B |
| 3,932,723 | 1/1976 | Tamano et al. | 219/10.55 B |
| 3,937,921 | 2/1976 | Furwichi et al. | 219/489 |
| 3,939,319 | 2/1976 | Tamano et al. | 219/10.55 B |
| 4,002,875 | 1/1977 | Kiuchi et al. | 219/10.55 B |
| 4,011,428 | 3/1977 | Fosnough et al. | 219/10.55 B |
| 4,015,145 | 3/1977 | Stewart | 307/265 |
| 4,039,868 | 8/1977 | Aono et al. | 307/265 |

FOREIGN PATENT DOCUMENTS

| | | | |
|---|---|---|---|
| 839551 | 6/1960 | United Kingdom | 219/492 |
| 950111 | 2/1964 | United Kingdom | 219/489 |
| 487383 | 6/1976 | U.S.S.R. | 323/DIG. 1 |

*Primary Examiner*—Elliot A. Goldberg
*Assistant Examiner*—M. Paschall
*Attorney, Agent, or Firm*—Spencer & Kaye

[57] ABSTRACT

In an electronic control device for electric ranges having a plurality of individual heat settings to selectively energize a heating element of the range under the control of a digital input to produce switching pulses having different on-off ratios, each heat setting has an associated time controlled constant power period in the start-cooking or roasting range, and in the subsequent finish-cooking range there are produced switch-on and switch-off pulses having a constant time pattern at every heat setting, while the time duration of the constant power period and the duration of the switch-on pulses in the finish-cooking range are different from one heat setting to another.

5 Claims, 3 Drawing Figures

ELECTRONIC CONTROL DEVICE FOR ELECTRIC RANGES

BACKGROUND OF THE INVENTION

The present invention relates to an electronic control device for electric ranges having a digital input for switching the effective power associated with individual heat settings, or "heat values" for each heating element of the range, by means of switching pulses having different on-off ratios.

An electric range is known which has an electronic switching device, as described, for example, in an information pamphlet published by the firm Frigidaire, entitled "Cook-N-Care Guide For Your New Frigidaire Touch-N-Cook Range", in which the term "heat values" is employed to refer to the different heat settings of a surface heating unit. In such a range, the heat of the surface heating units and of the oven are regulated in such a manner that the individual heat settings have associated with them different effective power levels resulting from the production of switching pulses of different on-off, or duty, ratios, or ratios of switch-on time to switch-on time + switch-off time. This is accomplished in that the control device varies the length of the switch-on pulse as well as the length of the interval period between switch-on pulses for different heat settings. The switch-on period within the individual heat settings extends from 10 to 100% of each on-off cycle in this case.

In the known control device it is not possible to start cooking with full power at the lower heat settings so that for the start of cooking with full power the highest setting must first be used. Upon completion of the start of cooking period, the range must again be switched to a lower effective power at a lower heat setting in order to finish the cooking or baking. Due to the long pauses when no power is being delivered at the lower heat settings, the temperature of the food being cooked fluctuates within such wide limits that no constant temperature can be attained.

SUMMARY OF THE INVENTION

It is an object of the present invention to effect automatic cooking and baking in electric ranges and to make possible, by merely controlling the energy input, attainment of a relatively accurate constant temperature for the effective power provided in the finish-cooking range.

These objects are accomplished, according to the present invention, by causing the supply of heating energy with respect to each heat setting to include an initial time-controlled switch-on period of constant power for the start of cooking and baking, and subsequent switch-on pulses and switch-off periods in the finish-cooking range which are controlled in such a manner that the duration of a cycle consisting of a switch-on period and a switch-off period is constant at every heat setting for the finish-cooking range while the duration of the constant power period in the starting range, and the duration of the pulses in the finish-cooking range are different for each heat setting.

The electronic control device according to the invention also has the advantage that start of cooking and finish-cooking take place automatically at all heat settings and a constant finish-cooking temperature is obtained by merely controlling the power input.

According to a further embodiment of the invention there is provided a heat setting having a constant power input in the starting range and in the finish-cooking range.

Preferably, the switch-on pulse lengths at the individual heat settings in the finish-cooking range are designed to be proportional to a corresponding digital number identifying the heat settings when the settings are so identified as in the Frigidare Touch-N-Cook range described in the above-cited pamphlet.

In order for the energy input to remain constant at the individual heat settings when fluctuations occur in the mains voltage, it is advisable to provide a total time counter for the on-off cycle, and a further counter for the power-on pulse lengths in the finish-cooking range, which further counter is connected to a voltage-frequency converter. With this voltage-frequency converter, the counting periods determining the power-on pulse lengths are shortened if there is excess power supply voltage and lengthened if the power supply voltage is too low.

According to a preferred embodiment, a program memory is provided which is connected with a digital input and which, when addressed, serves as automatic program control for starting, finish-cooking, roasting or baking programs which are stored in the program memory. Such a device can also be utilized in conjunction with thermostatically controlled heating elements.

DESCRIPTION OF THE PREFERRED EMBODIMENTS

Figure 1:
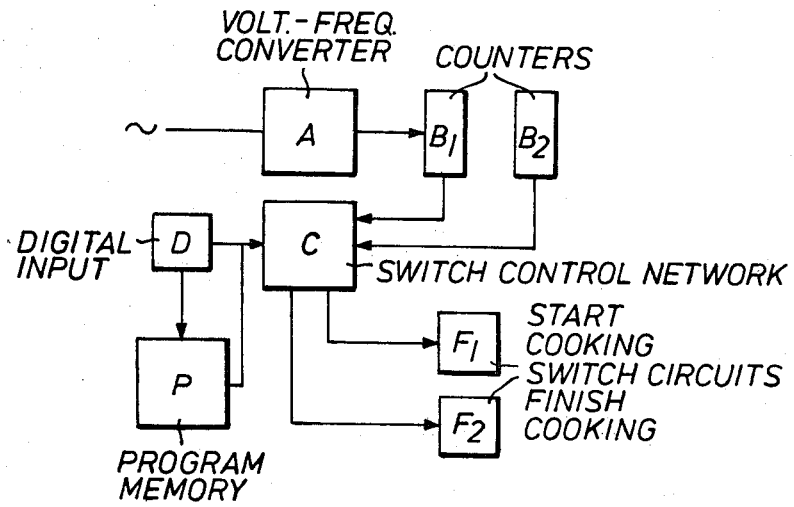
FIG. 1 is a block circuit diagram of the component units of the electronic control device according to a preferred embodiment of this invention.

The circuit shown in FIG. 1 includes a voltage-frequency converter A connected to a first counter B1. Counter B1 controls, together with a further counter B2, the operation of a switch control network C. Either the network C or a program memory P can be addressed through digital input D. If program memory P is addressed, the selected program is performed fully automatically via network C. Network C controls a switching circuit F1 for controlling the start-cooking range, or time, and a switching circuit F2 for controlling the finish-cooking range.

Counter B2 controls the total duration of each cycle consisting of a switch-on period plus a switch-off period, while counter B1 determines the duration of each individual pulse or switch-on period. The voltage-frequency converter A controls counter B1 in such a manner that the switch-on pulses are lengthened when the mains voltage is below its nominal value and shortened if there is excess mains voltage. This assures that a constant amount of effective power is fed to the heating units independently of fluctuations in the mains voltage.

Fixed programs for the cooking, roasting and baking times are stored in program memory P in such a manner that the memory controls the program sequence of an entire cooking or baking process. The selection of the memory is effected through digital input D by selecting a program identified by a certain number. The program memory can also be controlled by an oven circuit including a temperature sensor.

Figure 2:
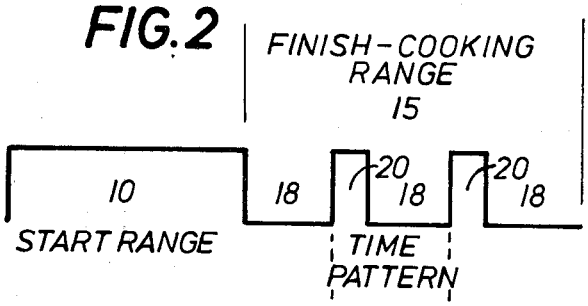
FIG. 2 is a diagram of a pulse pattern time sequence for an exemplary heat setting.

FIG. 2 shows the time sequence of the pulses for an exemplary heat setting. In the start range 10, full power is delivered during a relatively long period of time, different times being associated with the different heat settings. These times are controlled by circuit F1. This start range is followed by the finish-cooking range 15 which is composed of successive switching pulses 20. The time pattern, or cycle, consisting of a switch-on time 20 plus a switch-off time 18 is of constant duration at all heat settings, while the pulse durations 20 and the corresponding switch-off times 18 are different for the different heat settings. This makes it possible to select the time pattern so that in the finish-cooking range the food being cooked or baked will cook only very slightly during the switch-off periods and the temperature is kept relatively constant. The finish-cooking range is of indeterminate length and continues until the associated heating unit is turned off, either manually or by a timer incorporated in the appliance.

Upon switching from one heat setting to another during a start-cooking range 10, the circuit is designed so that heating continues in the start-cooking range only if the assigned duration of the start-cooking range of the newly selected heat setting, measured from the initiation of a heating operation, has not yet been exceeded. If under pulse control in the finish-cooking range, a new heat setting is selected, the pulsed operation of the finish-cooking range also becomes effective at the new setting. This is shown in the diagram of FIG. 3.

Figure 3:
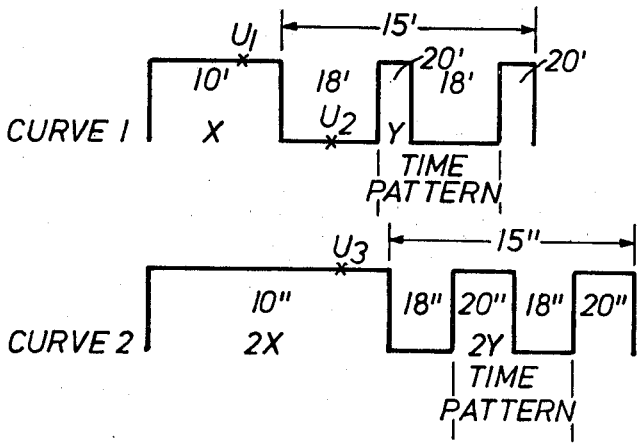
FIG. 3 is a diagram illustrating the comparative pulse pattern time sequence of two different heat settings.

Curve 1 of FIG. 3 shows the time sequence of the power applied at heat setting 1, e.g. the lowest heat setting, and curve 2 shows the time sequence for the next heat setting, 2. At setting 1 full power is switched on in the start-cooking range 10' for a period of time x; thereafter, power is applied in the finish-cooking range 15' by means of pulses 20' of the length y. Heat setting 2 in the start-cooking range 10'' has twice the length of power input $2x$ and the pulses 20'' in the finish-cooking range each have a length $2y$. However, the time pattern, or pulse repetition period, is the same at both heat settings. When switching from setting 1 to setting 2 at point $U_1$, the time remaining for the start-cooking range 10'' after the moment of switching continues to run at setting 2. Then follows the pulse pattern 18'', 20'' according to the finish-cooking range 15''.

If at time $U_2$ subsequent to the end of the start-cooking range of setting 1, the system is switched from setting 1 to setting 2, the start-cooking range 10'' of setting 2 will not be switched on but instead the pulse pattern of the finish-cooking range 15''. This applies also if the system is switched from setting 2 in the start-cooking range 10'' to setting 1 at a time which is later than the end of the start-cooking range 10' of setting 1, e.g. at point $U_3$. This switching also causes the pulse pattern of the finish-cooking range 15' to be effective in setting 1. Such an arrangement makes it possible to use shorter starting periods (10') and switch to higher finish-cooking power (20''), so that more "cooking power" is provided.

The electronic control device of this invention can be employed for controlling electric resistance type heating elements or ovens of the microwave type.

It will be understood that the above description of the present invention is susceptible to various modifications, changes and adaptations, and the same are intended to be comprehended within the meaning and range of equivalents of the appended claims.

What is claimed is:

1. In an electronic control device for an electric cooking appliance including at least one heating element arranged to be supplied with electric power for heating at a selected one of a plurality of different heat settings corresponding to respectively different heating levels, and digital input means for controlling the power supplied to the element in accordance with a selected heat setting by causing power pulses having a respectively different power-on to power-off ratio for each heat setting to be supplied to the element, the improvement comprising switching means connected for supplying in sequence to the element, at each heat setting, initial heating power, at the start of a heating operation, which is supplied continuously, and has a constant power level, for a selected time duration and, after the selected duration, a train of pulses of heating power having a selected, constant pulse duration and pulse repetition rate, said switching means including: control means connected to said input means for responding to the selected heat setting for causing the train of pulses to have the same repetition rate at all heat settings and for causing both the duration of each pulse of the pulse train and the duration of the initial heating power to differ from one heat setting to another; a first counter for producing output signals defining the pulse repetition rate of a train of pulses; a second counter for producing output signals defining the duration of each pulse of a train of pulses; and a voltage-frequency converter connected to monitor the voltage of the electric power supplied to the appliance and connected to said second counter for varying its counting rate as a function of changes in that voltage.

2. An arrangement as defined in claim 1 wherein said input means additionally controls the power supplied to the element in accordance with a further heat setting by causing constant power to be continuously supplied to the element for the entire duration of the further heat setting.

3. An arrangement as defined in claim 1 wherein the duration of each pulse in the pulse train at each heat setting is proportional to the heating level to which the respective heat setting corresponds.

4. An arrangement as defined in claim 1 further comprising a program memory constituting a source of cooking programs and connected to said input means and to said switching means for receiving from said input means address signals identifying a selected cooking program and controlling the operation of said switching means in accordance with such selected program.

5. An arrangement as defined in claim 1 further comprising additional control means effective when switching occurs from a first heat setting to a second heat setting subsequent to initiation of a heating operation for supplying heating power in the form of initial heating power of the second setting only if such switching occurs at a time after initiation of the heating operation which is within the duration of the initial heating power period of each of the first and second heat settings.

* * * * *